United States Patent [19]

Iwakura et al.

[11] Patent Number: 4,721,702

[45] Date of Patent: Jan. 26, 1988

[54] PRESSURE-SENSITIVE RECORDING MATERIAL

[75] Inventors: Ken Iwakura, Kanagawa; Hiroyuki Kawasaki; Shojiro Sano, both of Shizuoka, all of Japan

[73] Assignee: Fuji Photo Film Co., Ltd., Kanagawa, Japan

[21] Appl. No.: 841,962

[22] Filed: Mar. 20, 1986

[30] Foreign Application Priority Data

Mar. 20, 1985 [JP] Japan ..... 60-56570

[51] Int. Cl.[4] ..... B41M 5/16; B41M 5/22

[52] U.S. Cl. ..... 503/217; 427/151; 503/221; 503/222; 503/225; 549/227

[58] Field of Search ..... 346/217, 221, 222, 225; 427/151, 150; 549/227; 503/212, 217, 221, 222, 225

[56] References Cited

U.S. PATENT DOCUMENTS

| | | | |
|---|---|---|---|
| 3,837,889 | 9/1974 | Hughes et al. | 346/222 |
| 4,169,183 | 9/1979 | Mitchell | 346/222 |
| 4,390,616 | 6/1983 | Sato et al. | 346/221 |
| 4,433,156 | 2/1984 | Ishige et al. | 549/227 |
| 4,436,920 | 3/1984 | Sato et al. | 549/227 |

FOREIGN PATENT DOCUMENTS

| | | | |
|---|---|---|---|
| 0127711 | 10/1979 | Japan | 346/222 |
| 0043356 | 4/1981 | Japan | 346/222 |

*Primary Examiner*—Bruce H. Hess

*Attorney, Agent, or Firm*—Sughrue, Mion, Zinn, Macpeak & Seas

[57] ABSTRACT

A pressure-sensitive recording material is described, comprising an electron-accepting compound, and at least one of electron-donating colorless dyes represented by formula (I) or formula (II)

(I)

(II)

wherein $R_1$, $R_2$, $R_3$, $R_4$, $R_5$, $R_6$, $R_7$, and $R_8$ each represents a hydrogen atom, a lower alkyl group, a lower alkenyl group, a lower alkoxy group, or a halogen atom; and $R_9$ and $R_{10}$ each represents a hydrogen atom or a lower alkyl group, provided that at least one of $R_1$, $R_2$, $R_3$, and $R_4$ represents a lower alkyl group or a lower alkenyl group.

8 Claims, No Drawings

PRESSURE-SENSITIVE RECORDING MATERIAL

FIELD OF THE INVENTION

This invention relates to a pressure-sensitive recording material and, more particularly, to a pressure-sensitive recording material which provides color images having improved stability.

BACKGROUND OF THE INVENTION

A recording system utilizing color formation reaction between a substantially colorless electron-donating dye (hereinafter referred to as a color former) and an electron-accepting compound capable of developing a color upon contact with the color former (hereinafter referred to as a color developer) has hitherto been well known. Such a recording system has been embodied as, for example, pressure-sensitive copying paper, heat-sensitive recording paper, electrothermo-recording paper, and the like and is described, e.g., in U.S. Pat. Nos. 2,712,507, 2,730,456, 2,730,457, 3,418,250, 3,432,327, 3,981,821, 3,993,831, 3,996,156, 3,996,405, 4,000,087, etc.

These conventional recording materials include a combination of an upper sheet comprising a support having coated thereon a microcapsule layer containing microcapsules of oil droplets comprising a color former in an appropriate solvent, a lower sheet comprising another support having coated thereon a color developer layer, and, if desired, an intermediate sheet comprising a support having coated a microcapsule layer on one side thereof and a color developer layer on another side thereof; a single sheet containing the color former-containing mecrocapsules and the color developer as coated on the same side of a support; and a single sheet comprising a support containing either one of the color former-containing microcapsules and the color developer, with another being coated thereon; and the like.

It has been proposed as described in U.S. Pat. Nos. 4,436,920 and 4,390,616 to use a diarylaminofluoran derivative as a color former in these recording materials, with which color images having remarkably excellent light-fastness can be provided.

However, this color former has a disadvantage of poor solubility in solvents used for the synthesis thereof or solvents used for encapsulation thereof.

SUMMARY OF THE INVENTION

Accordingly, an object of the present invention is to provide a pressure-sensitive recording material containing a diarylaminofluoran derivative having improved solubility in solvents used for the synthesis or encapsulation thereof.

This object can be accomplished by a pressure-sensitive recording material comprising an electron-accepting compound, and a diarylaminofluoran derivative represented by formula (I) or (II) as the color former (I)

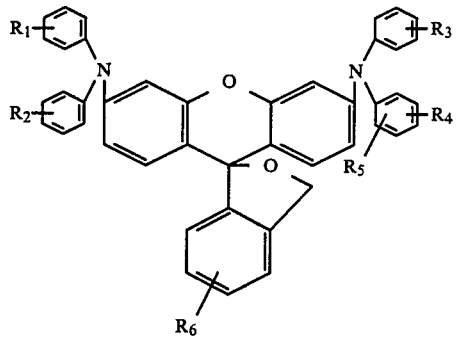

(II)

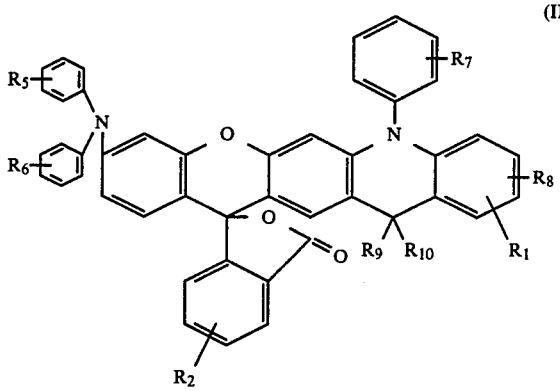

wherein $R_1$, $R_2$, $R_3$, $R_4$, $R_5$, $R_6$, $R_7$, and $R_8$ (which may be the same or different) each represents a hydrogen atom, a lower alkyl group, a lower alkenyl group, a lower alkoxy group, or a halogen atom; and $R_9$ and $R_{10}$ (which may be the same or different) each represents a hydrogen atom or a lower alkyl group, provided that at least one of $R_1$, $R_2$, $R_3$, and $R_4$ represents a lower alkyl group or a lower alkenyl group.

DETAILED DESCRIPTION OF THE INVENTION

In the above-described formulae (I) and (II), the substituents as represented by $R_1$, $R_2$, $R_3$, $R_4$, $R_5$, $R_6$, $R_7$, and $R_8$ are preferably selected from the group consisting of a hydrogen atom, a lower alkyl group having from 1 to 5 carbon atoms, a lower alkenyl group having from 2 to 5 carbon atoms, a lower alkoxy group having from 1 to 5 carbon atoms, a chlorine atom, a fluorine atom, and a bromine atom. More preferably, they are selected from the group consisting of a hydrogen atom, a methyl group, an ethyl group, a propyl group, an isopropyl group, a butyl group, an isobutyl group, a sec-butyl group, an isopropenyl group, a methoxy group, an ethoxy group, a propyloxy group, a chlorine atom, and a bromine atom, The substituents as represented by $R_9$ and $R_{10}$ preferably include a hydrogen atom and an alkyl group having from 1 to 5 carbon atoms, and more preferably a hydrogen atom, a methyl group, and an ethyl group.

In the above-described formulae (I) and (II), at least one of $R_1$, $R_2$, $R_3$, and $R_4$ represents a lower alkyl group or a lower alkenyl group, and preferably a branched lower alkyl group or a branched lower alkenyl group.

The diarylaminofluoran derivatives as represented by formula (I) or (II) exhibit satisfactory solubility in organic solvents, such as toluene, ethyl acetate, acetone, etc., and encapsulation solvents, such as alkylated naphthalenes, dipthenylalkanes, alkylated bipthenyls, etc. The pressure-sensitive recording materials containing the diarylaminofluoran derivatives of this invention provide color images which have high color densities and exhibit remarkably high stability, being substantially free from discoloration or decoloration due to long-term exposure to light, heat, or humidity, and also satisfactory resistance to developing solutions for diazo-type copying paper or plasticizers for vinyl chloride sheets, etc. Further, the pressure-sensitive recording materials containing the color former represented by formula (II) exhibit extremely satisfactory suitability for electrophotographic copying.

Typical examples of the diarylaminofluoran derivatives according to the present invention are shown below.

(1)

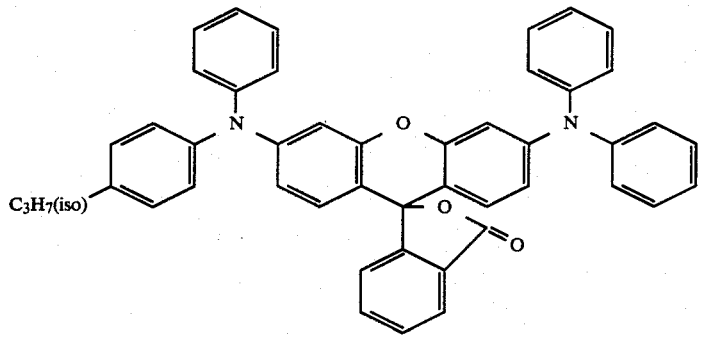

(2)

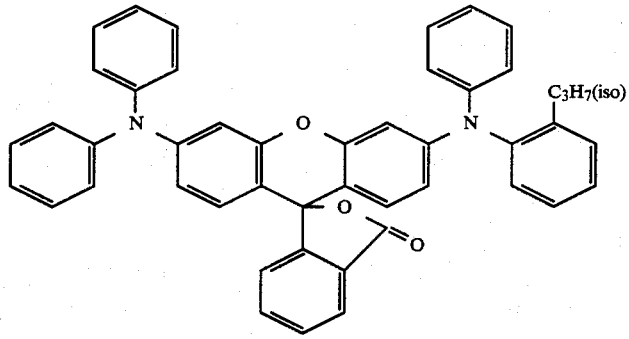

(3)

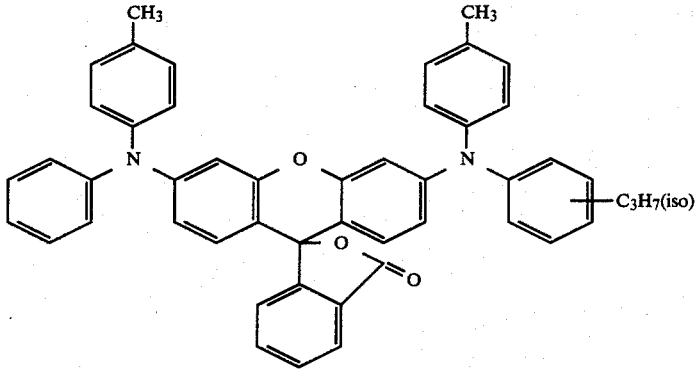

(4)

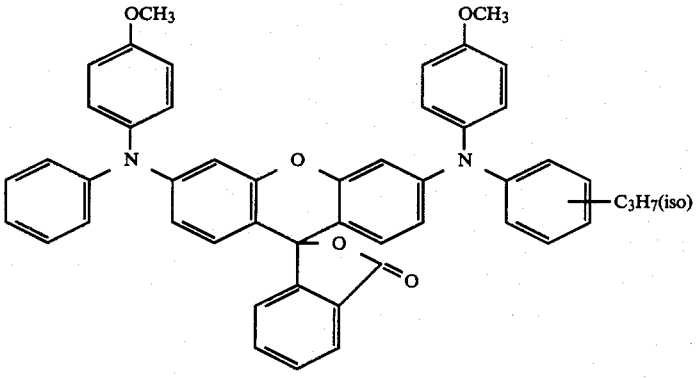

-continued
(5)
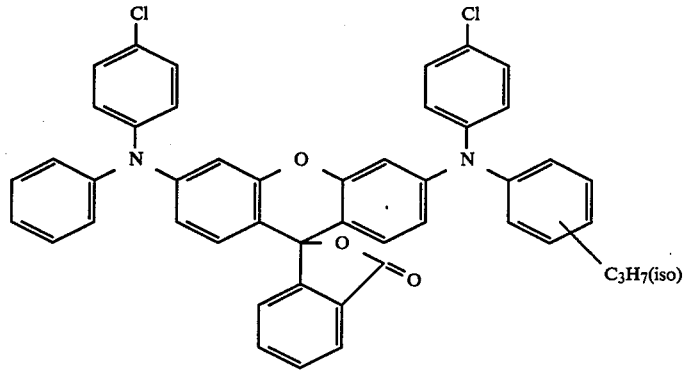
(6)
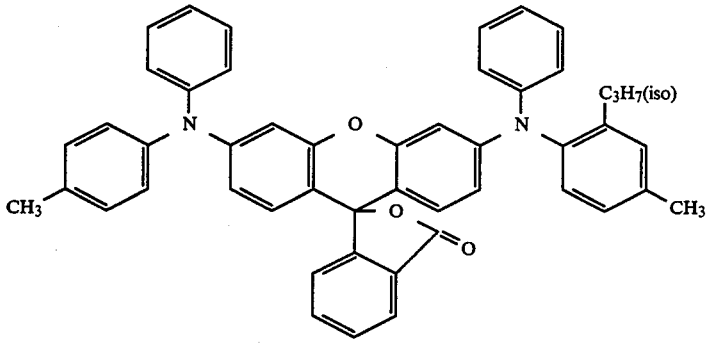
(7)
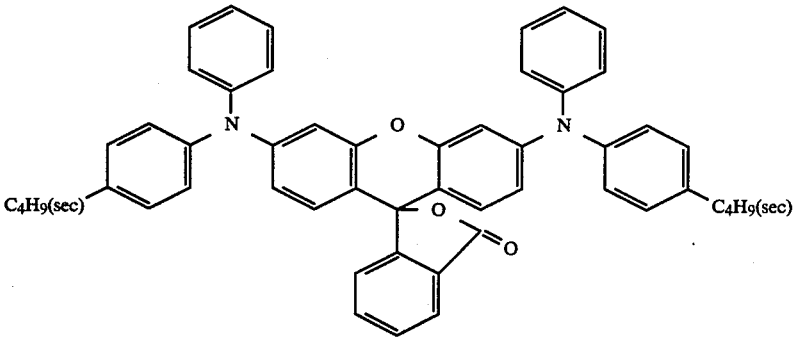
(8)
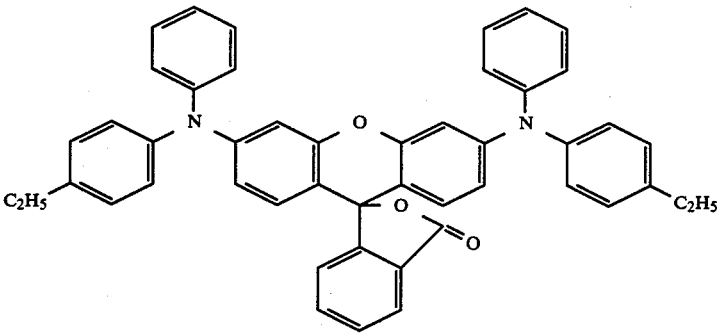

-continued
(9)
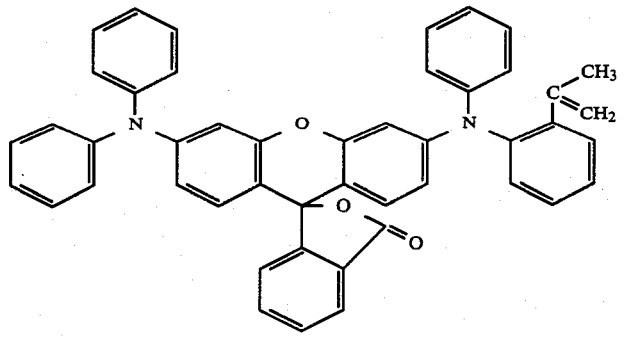
(10)
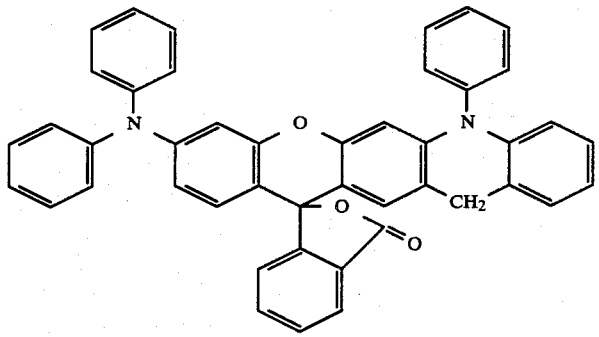
(11)
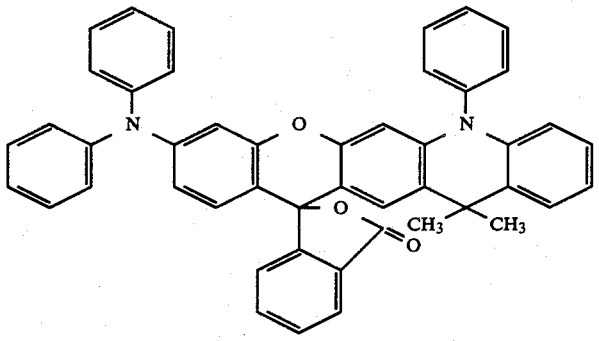
(12)
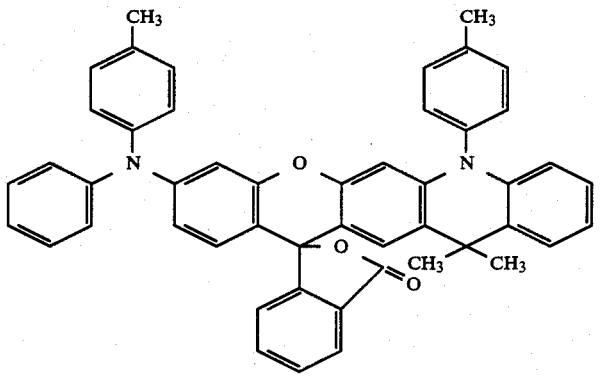

-continued (13)

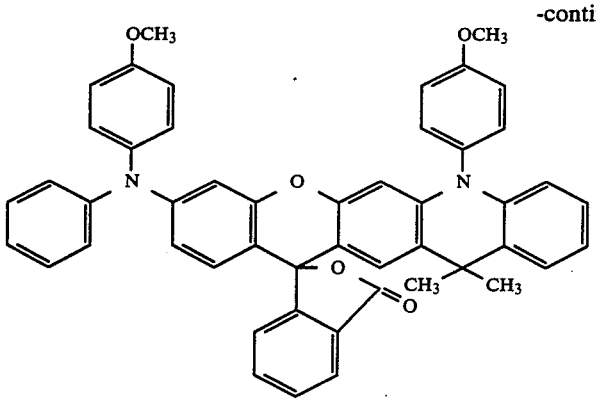

(14)

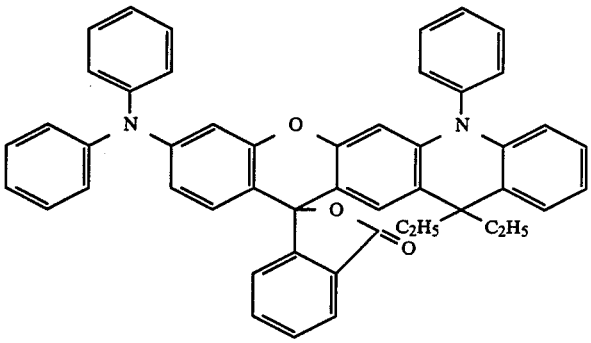

(15)

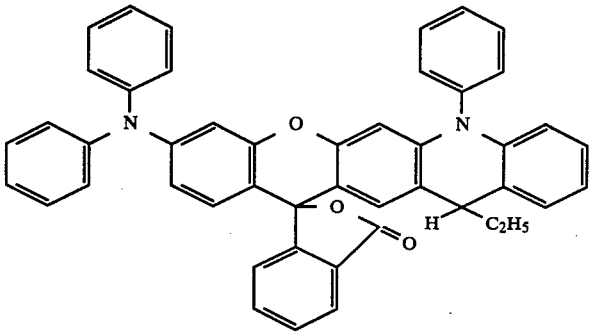

(16)

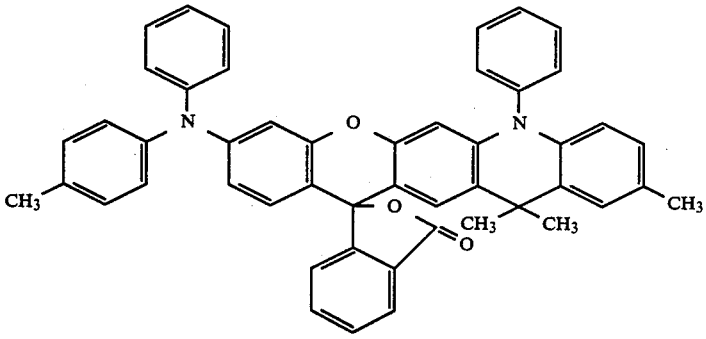

These color formers may be used either alone or in combinations of two or more thereof.

These diarylaminofluoran derivatives may be used in combination with other conventional color formers without any problem. Conventional color formers which can be used in such combination include triarylmethane compounds, diphenylmethane compounds, xanthene compounds, thiazine compounds, spiro compounds, and other color formers having a diarylamino group in their partial skeleton, and mixtures of these color formers. Of these, color formers containing a diarylamino group in the structure thereof are preferably used in combination with the compounds of the present invention. Specific examples of such compounds are shown below.

(1)
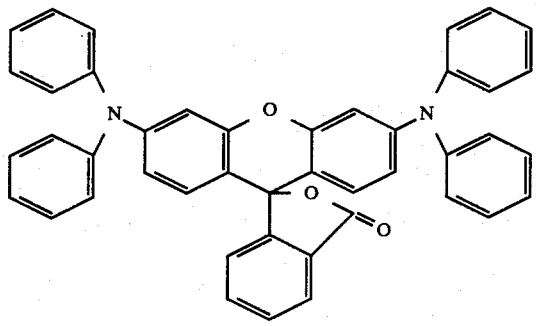
(2)
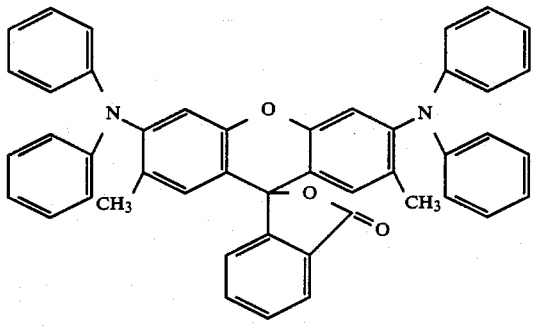
(3)
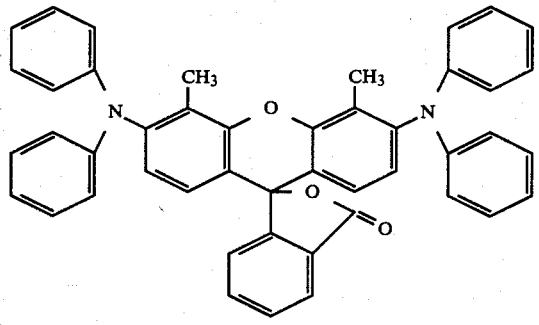
(4)
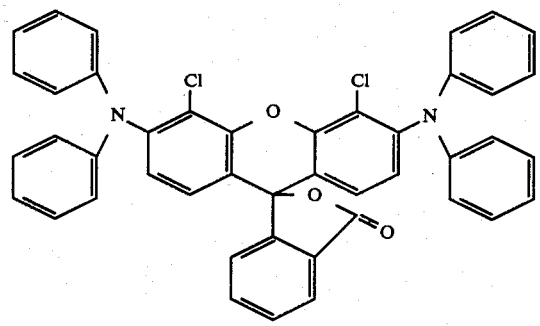
(5)
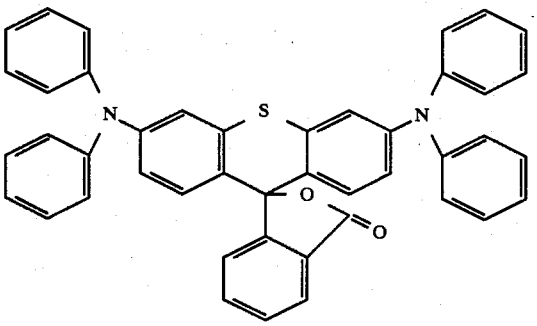
-continued
(6)
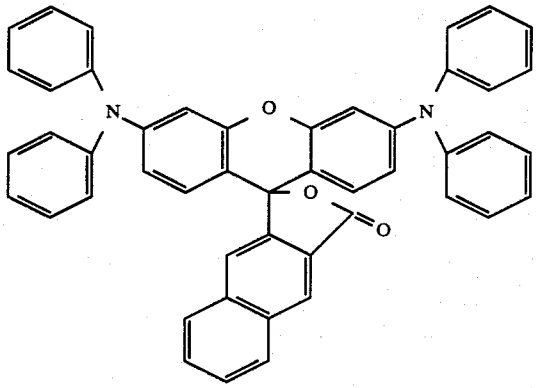
(7)
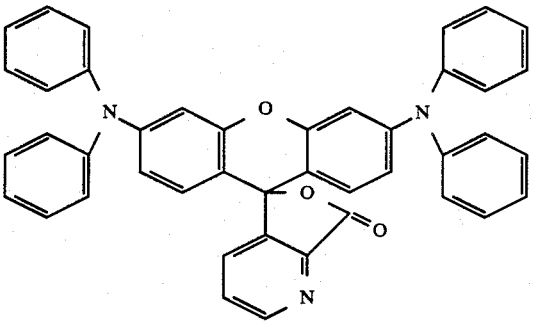
(8)
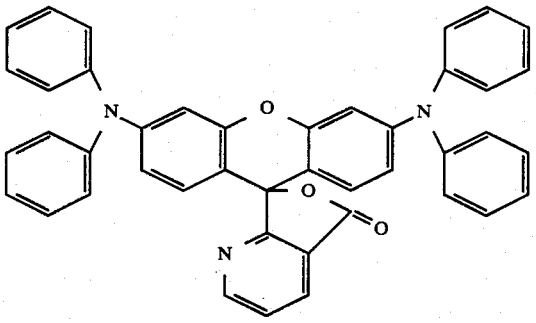
(9)
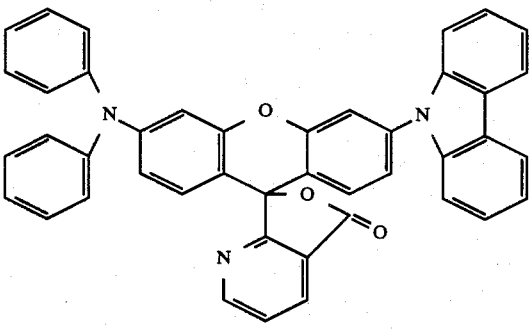

-continued (10)

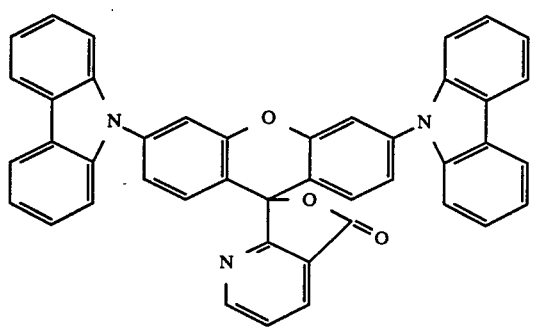

(11)

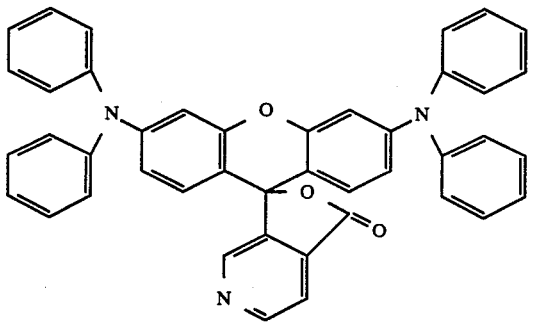

(12)

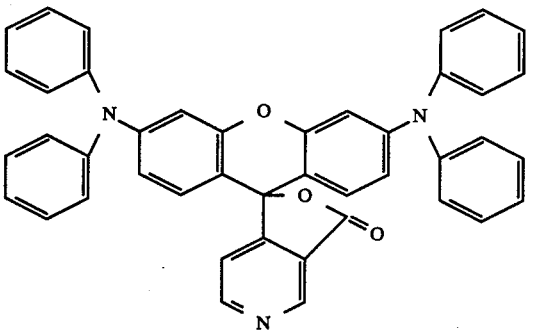

The fluoran derivatives according to the present invention can typically be synthesized by reacting a diphenylamine derivative and resorcin in the presence of a catalyst to obtain an m-hydroxytripthenylamine derivative, and reacting the resulting product with phthalic anhydride in the presence of an acid catalyst, and the synthesis method is described, for example, in U.S. Pat. Nos. 4,436,920 and 4,390,616.

The catalyst to be used for the reaction between the diphenylamine derivatives and resorcin includes phosphorus compounds, such as phosphoric acid, phosphorous ester, polyphosphoric acid, etc. The catalyst to be used for the reaction with phthalic anhydride includes Lewis acids, e.g., aluminum chloride, zinc chloride, magnesium chloride, etc., and Brø nsted acids, e.g., sulfuric acid, p-toluenesulfonic acid, methanesulfonic acid, etc.

Specific examples of synthesis of the fluoran derivatives according to the present invention are shown below.

SYNTHESIS EXAMPLE 1

Synthesis of
3′,6′-Bis-(N-p-Isopropylphenylamino)Spiro[Isobenzofuran-1(3H),9′-(9H)-Xanthen]-3-one N-p-Isoptropylphenylaniline and double the molar amount of resorcin were reacted at 200° C. for 10 hours in the presence of a phosphoric acid catalyst to obtain 4-isopropyl-3′-hydroxytriphenylamine. In the resulting product was dissolved double the molar amount of phthalic anhydride while heating at 150° C. for 2 hours in the presence of a zinc chloride catalyst. After completion of the reaction, the reaction mixture was poured into water, and extracted with toluene. The toluene extract was distilled to remove the toluene, and the residue was purified by column hromatography on a silica gel column using a toluene/hexane eluent to obtain 3′,6′-bis-(N-p-isopropylphenylamino)spiro[isobenzofuran-1(3H),9′-(9H)-xanthen]-3-one.

SYNTHESIS EXAMPLE 2

Synthesis of
3′-Diphenylamino-6′-(N-p-Isopropylphenylanilino)-Spiro)[Isobenzofuran-1(3H),9′(9H)-Xanthen]-3-one and 3-Diphenylamino-7,12-Dihydro-12,12-Dimethyl-7-Phenyl-Spiro[14H-[1]Benzopyrano[3,2-b]Acridine-14,1′[3′H]Isobenzofuran]-3′-one Diphenylamine and 5 times the molar amount of resorcin were reacted at 200° C. for 20 hours in the presence of a phosphoric acid catalyst to obtain a hydroxytriphenylamine derivative. In the product was dissolved double the molar amount of phthalic anhydride by heating at 150° C. for 4 hours in the presence of a zinc chloride catalyst. After completion of the reaction, the reaction mixture was worked up in the same manner as in Synthesis Example 1 to obtain 3′-diphenylamino-6′-(N-p-isopropylphenylanilino)-spiro[isobenzofuran-1(3H),9′-(9H)-xanthen]-3-one and 3-diphenylamino-7,12-dihydro-12,12-dimethyl-7-phenyl-spiro[14H-[1]benzopyrano[3,2-b]acridine-14,1′[13′H]-isobenzofuran]-3′-one.

The pressure-sensitive recording materials of the present invention can have various forms as described, e.g., in U.S. Pat. Nos. 2,505,470, 2,505,471, 2,505,489, 2,548,366, 2,712,507, 2,730,456, 2,730,457, and 3,418,250, etc. The most commonly employed form comprises at least one pair of sheets, one of which containing an electron-donating colorless dye and another containing an electron-accepting compound. In more detail, a color former sheet is prepared by dissolving one or more of the electron-donating colorless dyes in an oily solvent, such as alkylated naphthalenes, alkylated diphenyls, alkylated diphenylmethanes, alkylated diarylethanes, chlorinated paraffin, etc., dispersing the solution in a binder or encapsulating the solution, and coating the dispersion or microcapsules on a support, such as paper, plastic sheets, resin-coated paper, etc. On the other hand, a color developer sheet is prepared by dispersing one or more of the electron-accepting comptounds, if desired, together with other electron-accepting compounds in a binder, e.g., a styrene-butadiene latex, polyvinyl alcohol, etc., and coating the dispersion on a support, such as paper, plastic sheets, resin-coated paper, etc.

The amounts of the electron-donating colorless dyes and the electron-accepting compounds to be used can be easily decided by one skilled in the art depending on the coating film thickness, form of the pressure-sensitive copying paper, encapsulation process, and other conditions. Generally, the amount of the electron-donating dyes to be used is from 0.01 to 0.5 g/m$^2$, preferably from 0.03 to 0.2 g/m$^2$, and the amount of the electron-accepting compounds to be used is from 0.05 to 1 g/m$^2$, preferably from 0.1 to 0.5 g/m$^2$.

Processes for encapsulation include a process utilizing coacervation of a hydrophilic colloid sol as described in U.S. Pat. Nos. 2,800,457 and 2,800,458 and an interfacial polymerization process as described in British Pat. Nos. 867,797, 950,443, 989,264, 1,091,076, etc.

In the encapsulation, ultraviolet absorbents, antioxidants and the like may be added, if desired. The ultraviolet absorbents to be used preferably have a spectral absorption maximum between 270 to 380 nm. Of these, the more preferred are benzotriazole compounds, with 2(2'-hydroxy-5'-methylphenyl)benzotriazole being the most preferred. The antioxidants to be used are preferably amines and phenols, and diphenylamine, phenylenediamine, quinoline, hindered amine, and hindered phenol are particularly preferred.

Examples of the electron-accepting compounds which can be used in the present invention include clay substances, e.g., acid clay, activated clay, attapulgite, zeolite, bentonite, kaolin, etc., metal salts of aromatic carboxylic acids, and phenolic resins.

The present invention is illustrated in greater detail with reference to the following examples, but it is to be understood that these examples do not limit the present invention. In these examples, all the percents are by weight unless otherwise indicated.

EXAMPLE 1

Preparation of Color Former Sheet

In 30 g of a diisopropyl naphthalene was dissolved 1.8 g of Color Former (2), and the solution was added to a solution of 6 g of gelatin and 4 g of gum arabic in 50 g of water under vigordus stirring to effect emulsification to form oil droplets having a diameter of from 1 to 10 μm. To the emulsion was added 250 g of water, and acetaic acid was added thereto in small portions to adjust pH to about 4, whereby coacervation was induced to form capsule walls comprising gelatin and gum arabic around oil droplets, After formalin (37 wt % formaldehyde solution) was added thereto, the pH value was raised to 9 to harden the wall.

The thus-prepared microcapsule dispersion was coated on paper and dried to obtain a color former sheet.

Preparation Color Developer Sheet

Fifteen grams of zinc 3,5-bis(α-methylbenzyl)-salicylate as an electron-accepting compound, 170 g of calcium carbonate, 20 g of zinc oxide and 1 g of sodium hexametaphosphoric acid were dispersed in 200 ml of water in a sand grinder. To 400 g of the resulting dispersion were added 100 ml of a 10% aqueous solution of polyvinyl alcohol (degree of saptonification: 99%, degree of polymerization: 1,000) and 10 g of a carboxyl-modified SBR latex, and water was further added thereto so as to result in a solids concentration of 20% by weight. The resulting coating composition was coated on paper and dried to obtain a color developer sheet.

The thus-prepared color former sheet and color developer sheet were brought into contact. Application of pressure or impact on the resulting recording material instantaneously provided a blue image having a high color density and excellent fastness to light and heat.

EXAMPLE 2

A color former sheet was prepared in the same manner as described in Example 1, except for using 0.7 g of Color Former (11) and 0.9 g of 3,6-bis(dipthenylamino-fluoran) in place of Color Former (2).

When the resulting color former sheet was brought into contact with the same color developer sheet as prepared in Example 1, and pressure or impact was applied thereon a blue image was instantaneously obtained. This image had a high color density and was excellent in fastness to light and heat.

EXAMPLE 3

A color former sheet was prepared in the same manner as described in Example 1, except for using a mixture of Color Formers (1), (2), and (11), 3,6-bis(diphenylamino)-fluoran and 5-phenyl-11-diphenylamino-spiro[8H-[1]benzo[3,2-c]acridine-8,1'(3H)-isobenzofuran]-3'-one in place of Color Former (2).

When the resulting color former sheet was brought into contact with the same color developer sheet as prepared in Example 1, and pressure or impact was applied thereon, a blue image was instananeously obtained. The image had a high color density and was excellent in fastness to light and heat.

EXAMPLE 4

Four grams of 3,6-bis(diphenylamino)fluoran and 1.0 g of Color Former (1) as electron-donating colorless dye and 2.0 g of 2-(2'-hydroxyl-5'-methylphenyl)benzotriazole as an ultraviolet absorbent were dissolved in 100 g of diisoptropylnaphthalene, and the resulting color former oily solution was emulsified in 100 g of a 4.4% aqueous solution of a partial sodium salt of polyvinylbenzenesulfonic acid (average molecular weight: 500,000) having been adjusted to a pH of 4 to obtain an oil-in-water water emulsion having an average particle size of 4.5 μm.

Separately, 6 g of melamine, 11 g of a 37% formaldehyde aqueous solution and 83 g of water were stirred under heating at 60° C. for 30 minutes to form a clear mixed aqueous solution of melamine, formaldehyde and a melamine-formaldehyde initial condensate. The resulting mixed aqueous solution was mixed with the above-prepared emulsion, and the mixture was adjusted to a pH of 6.0 with a 20% acetic acid aqueous solution while stirring. The liquid temperature was elevated up to 65° C., at which the mixture was maintained for 30 minutes to complete encaptsulation.

To the resulting microcapsule dispersion were added 200 g of a 20% aqueous solution of etherified starch, 47 g of starch particles (average particle size: 40 μm) and 10 g of talc. Water was then added thereto to adjust to a solid concentration of 20% by weight.

The resulting microcapsule dispersion was coated on paper having a basis weight of 40 g/m$^2$ by an air-knife coator to a dry coverage of 5 g/m$^2$, and dried to obtain a color former sheet.

The thus-obtained color former sheet was brought into contact with each of paper sheets coated with activated clay, acid clay, attapulgite, a phenolic resin, 4,4'-isopropylidenediphenol, zinc 3,5-bis(α-methylbenzyl)-salicylate, zinc p-toluenesulfonate, or 2,2'-methylenebisphenol. Upon application of pressure or impact, there was instantaneously obtained a blue image in each case. These images had high color densities and exhibited excellent fastness to light and heat.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording material comprising, on a support, an electron-accepting compound, and at least one electron-donating colorless dye represented by formula (I) or formula (II)

(I)

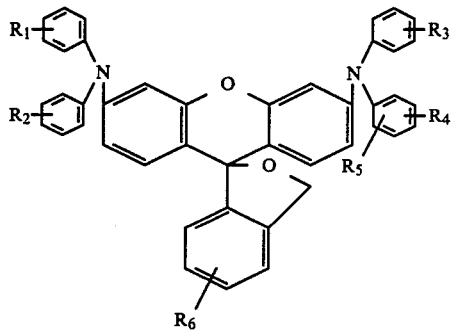

(II)

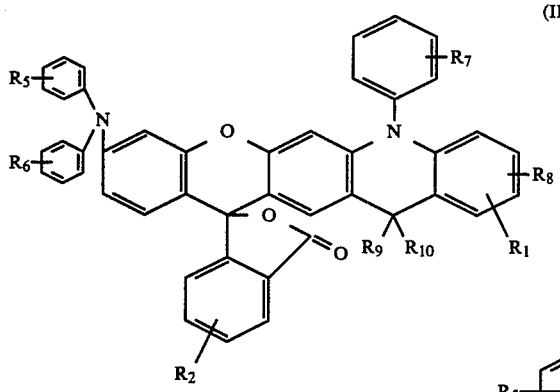

wherein $R_1$, $R_2$, $R_3$, $R_4$, $R_5$, $R_5$, $R_7$, and $R_8$ each represents a hydrogen atom, a lower alkyl group, a lower alkenyl group, a lower alkoxy group, or a halogen atom; and $R_9$ and $R_{10}$ each represents a hydrogen atom or a lower alkyl group, provided that for formula II at least one of $R_1$, $R_2$, $R_3$, and $R_4$ represents a lower alkyl group or a lower alkenyl group, and for formula I at least one of $R_3$, $R_2$, $R_3$, and $R_4$ represents a branched lower alkyl group or a branched lower alkenyl group.

2. A pressure-sensitive recording material as in claim 1, wherein $R_1$, $R_2$, $R_3$, $R_4$, $R_5$, $R_6$, $R_7$, and $R_8$ each represents a member selected from the group consisting of a hydrogen atom, a lower alkyl group having from 1 to 5 carbon atoms, a lower alkenyl group having from 2 to 5 carbon atoms, a lower alkoxy group having from 1 to 5 carbon atoms, a chlorine atom, a fluorine atom, and a bromine atom.

3. A pressure sensitive recording material as in claim 2, wherein $R_1$, $R_2$, $R_3$, $R_4$, $R_5$, $R_6$, $R_7$, and $R_8$ each represents a member selected from the group consisting of a hydrogen atom, a methyl group, an ethyl group, a propyl group, an isopropyl group, a butyl group, an isobutyl group, a sec-butyl group, an isopropenyl group, a methoxy group, an ethoxy group, a propyloxy group, a chlorine atom, and a bromine atom.

4. A pressure-sensitive recording material as in claim 1, wherein $R_9$ and $R_{10}$ each represents a hydrogen atom or an alkyl group having from 1 to 5 carbon atoms.

5. A pressure-sensitive recording material as in claim 4, wherein $R_9$ and $R_{10}$ each represents a hydrogen atom, a methyl group, or an ethyl group.

6. A pressure-sensitive recording material as in claim 1, wherein said electron-accepting compound is selected from the group consisting of a clay substance, a metal salt of an aromatic carboxylic acid, and a phenolic resin.

7. A pressure-sensitive recording material as in claim 1, wherein at least one of $R_1$, $R_2$, $R_3$ or $R_4$ represents an isopropyl group.

8. A pressure-sensitive recording material comprising, on a support, an electron-accepting compound, and at least one electron-donating colorless dye represented by formula (II)

(II)

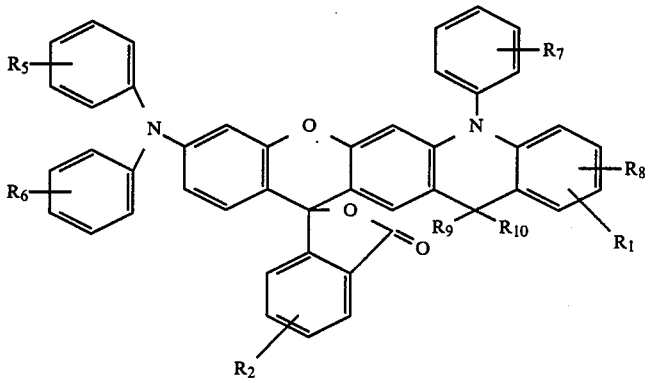

wherein $R_1$, $R_2$, $R_3$, $R_4$, $R_5$, $R_6$, $R_7$, and $R_8$ each represents a hydrogen atom, a lower alkyl group, a lower alkenyl group, a lower alkoxy group, or a halogen atom; and $R_9$ and $R_{10}$ each represents a hydrogen atom or a lower alkyl group, and at least one of $R_1$, $R_2$, $R_3$, and $R_4$ represents a lower alkyl group or a lower alkenyl group.

* * * * *